US005247783A

United States Patent [19]

Hannen

[11] Patent Number: 5,247,783

[45] Date of Patent: Sep. 28, 1993

[54] SYSTEM FOR WRAPPING PALLETIZED GOODS

[75] Inventor: Reiner W. Hannen, Goch-Pfalzdorf, Fed. Rep. of Germany

[73] Assignee: Develog, Reiner Hannen & Cie, Cortebert, Switzerland

[21] Appl. No.: 758,863

[22] Filed: Sep. 12, 1991

[30] Foreign Application Priority Data

Sep. 13, 1990 [DE] Fed. Rep. of Germany ... 9013049[U]
Apr. 4, 1991 [DE] Fed. Rep. of Germany ... 9104072[U]

[51] Int. Cl.[5] ..... B65B 51/14
[52] U.S. Cl. ..... 53/567; 53/556
[58] Field of Search ..... 53/442, 441, 459, 557, 53/556, 567, 570, 383.1

[56] References Cited

U.S. PATENT DOCUMENTS

| | | | |
|---|---|---|---|
| 3,522,688 | 8/1970 | Kaliwoda et al. | 53/442 |
| 3,807,126 | 4/1974 | Schwarz | 53/442 |
| 3,925,964 | 12/1975 | Birkenfeld et al. | 53/567 |
| 4,063,401 | 12/1977 | Higgins | 53/567 |
| 4,064,678 | 12/1977 | Grocke | 53/567 |
| 4,258,533 | 3/1981 | Aka et al. | 53/557 |
| 4,575,989 | 3/1986 | Hannen | 53/442 X |
| 4,616,471 | 10/1986 | Hannen | 53/442 |
| 4,724,652 | 2/1988 | Birkenfeld | 53/567 X |
| 4,724,658 | 2/1988 | Birkenfeld et al. | 53/567 X |
| 5,042,235 | 8/1991 | Hannen et al. | 53/557 |

FOREIGN PATENT DOCUMENTS 9001319 2/1990 Fed. Rep. of Germany .

*Primary Examiner*—John Sipos
*Assistant Examiner*—Daniel Moon
*Attorney, Agent, or Firm*—Herbert Dubno; Andrew Wilford

[57] ABSTRACT

A package of goods having a lower surface is wrapped by first pulling a bag down over the stack until a lower edge of the bag hangs past the stack, then grabbing the hanging lower edge and pulling the grabbed edge down to pull the bag snugly over the package. This grabbed edge is then pressed against the lower package surface and is attached to the lower package surface. The lower edge is grabbed at at least two opposite locations and is there pulled, pressed, and attached. The grabbed edge is pulled down by gripping the grabbed edge and lifting the package. The edge can be attached by gluing it to the surface or by welding it to the surface.

11 Claims, 8 Drawing Sheets

SYSTEM FOR WRAPPING PALLETIZED GOODS

FIELD OF THE INVENTION

The present invention relates to a system for wrapping palletized goods. More particularly this invention concerns a method of and apparatus for fitting a bag or hood over such a package and then securing it underneath the pallet.

BACKGROUND OF THE INVENTION

Palletized goods are normally wrapped by pulling a bag or hood down over them and then securing the hood to the pallet. To this end the bag is bunched up on holders that are aligned above the corners of the package and that are pulled apart so that they can be moved down over the package, with the bag pulling upward off them. As described in German utility model 90 01 319 some retaining means or brake is frequently provided to inhibit the bag from pulling off and being left too loose on the package.

Under the best of circumstances such arrangements frequently leave the wrapping too loose at least in the middles of the sides of the package. As a result the package is not resistant to diagonal forces and can easily be upset if one corner of a side is pushed or pulled opposite to the diagonally opposite corner.

OBJECTS OF THE INVENTION

It is therefore an object of the present invention to provide an improved system for wrapping a package of palletized goods.

Another object is the provision of such an improved system for wrapping a package of palletized goods which overcomes the above-given disadvantages, that is which spans the bag tightly over the package and fastens it securely thereunder.

SUMMARY OF THE INVENTION

A package of goods having a lower surface is wrapped according to this invention by first pulling a bag down over the stack until a lower edge of the bag hangs past the stack, then grabbing the hanging lower edge and pulling the grabbed edge down to pull the bag snugly over the package. This grabbed edge is then pressed against the lower package surface and is attached to the lower package surface.

Thus the bag is not simply pulled down over the package and its lower edge attached underneath it, but instead according to the invention the lower edge is actually grabbed and pulled downward, ensuring that the bag is tight. While it is held under tension it is attached to the bottom surface of the package so that the tension is maintained.

According to this invention the lower edge is grabbed at at least two opposite locations and is there pulled, pressed, and attached. The grabbed edge is pulled down by gripping it and lifting the package The edge can be attached by gluing it to the bottom surface or by welding it to this surface.

The apparatus according to this invention has grippers for grabbing the hanging lower edge and pulling the grabbed edge down to pull the bag snugly over the package. These grippers are provided opposite each other on opposite sides of the package. They are upwardly open and are closable to grip the edge.

In accordance with this invention the means for attaching includes a nozzle for spraying glue on an inner face of the bag at the lower edge before pressing same against the lower package surface. Rollers press the lower edge against the lower package surface. These rollers are biased upward against the lower package surface.

The means for attaching can also include means for heating the lower edge and thereby welding it to the lower package surface. The heating means can include a plurality of heated rockers engageable through the lower edge with the lower package surface and means for pressing the rockers against the lower surface and rocking them thereon. The rockers are carried on respective levers pivoted on a slide displaceable horizontally under the package. A spring is engaged between each rocker an the respective slide to urge the rocker upward. Each rocker is provided with at least one electrically heatable strip. A spring is engaged between each rocker and the respective arm to urge the respective rocker into a position projecting up above a plane of the lower surface of the package. Conveyor rollers transport the package through a station provided with the rockers. The rockers are engageable between the rollers with sides of the package, but rock over and engage the bottom of the package as they are pushed under it.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
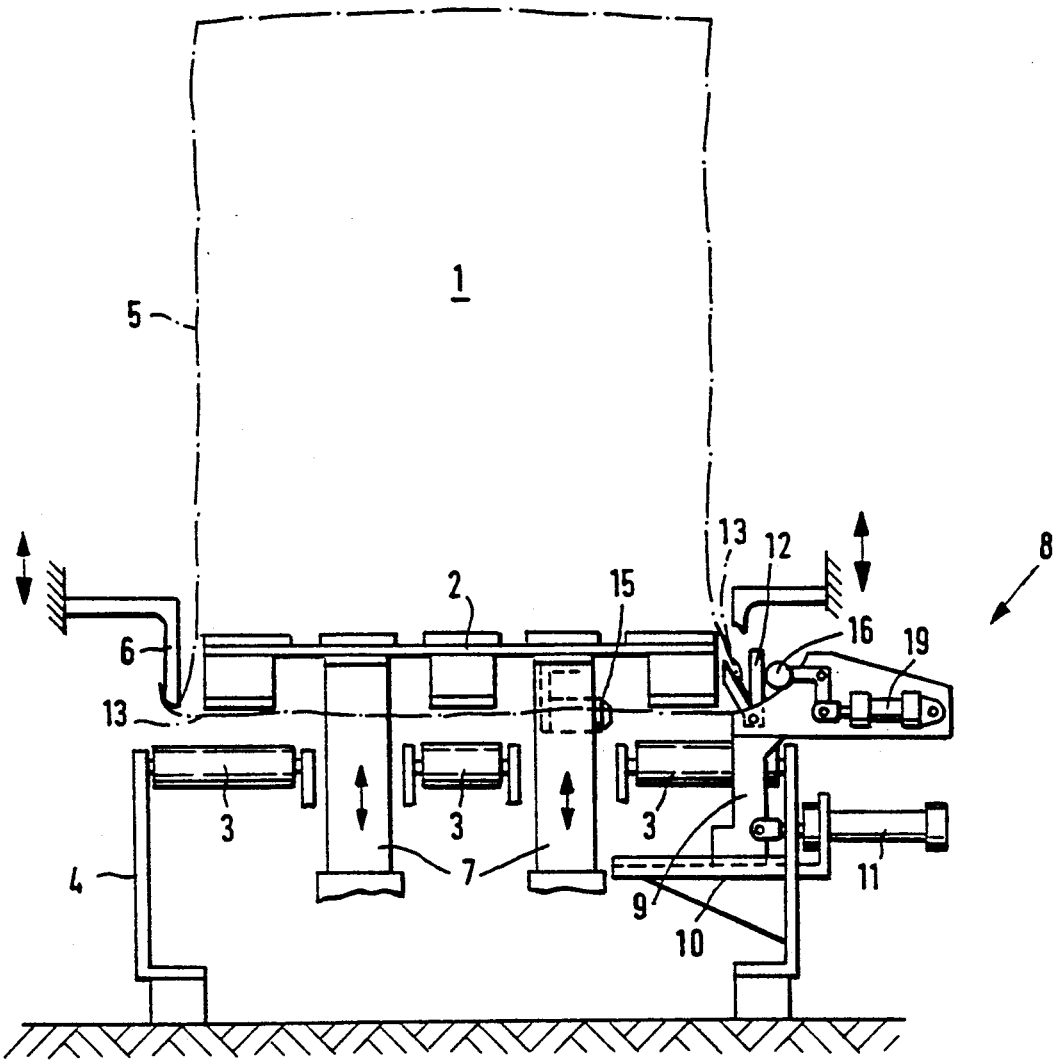
FIGS. 1 through 3 are end views illustrating the method and apparatus of this invention in successive steps of the method.

As seen in FIG. 1 a stack 1 of articles on a pallet 2 is normally moved longitudinally and horizontally on rollers 3 of a transport conveyor 4. A bag or hood 5 is engaged by four holders 6 of conventional design and is pulled down over the stack until a lower edge 13 of the bag 5 hangs below the stack 1 at or below the pallet 2. As described in the above-mentioned German Utility Model the bag 5 is bunched up accordion-fashion over the four holders 6 which are then separated and pulled down over the stack 1 so that the bag 5 pulls off these holders 6 to snugly surround the stack 1. The bag 5 may be made of a heat-shrinkable resin so that it can be heat-shrunk tightly around the stack 1.

According to this invention the stack 1 and pallet 2 are raised off the rollers 3 by lifters 7 that engage the pallet 2 well inward of its edges so that devices 8 can secure the lower edge 13 underneath the pallet 2. Two gripper tongs 12 are provided on each longitudinally extending side of the package to grab the lower edge 13. These grippers 12 are each carried on a slide 9 movable in a transverse guide 10 by means of a respective actuator 11. The grippers 12 can be closed by actuators 14

Figure 4:
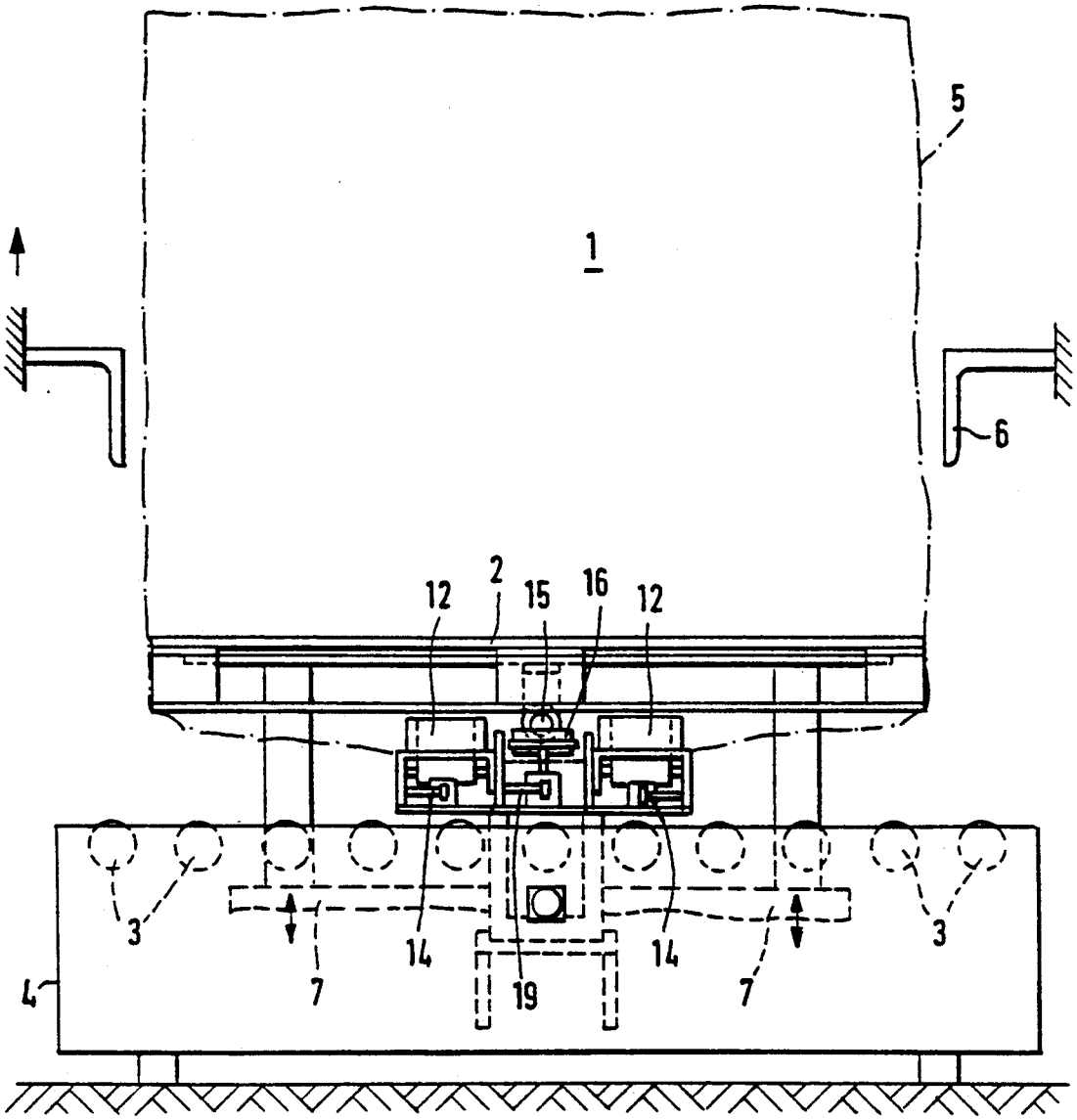
FIG. 4 is a side view corresponding to FIG. 1.
Figure 5:
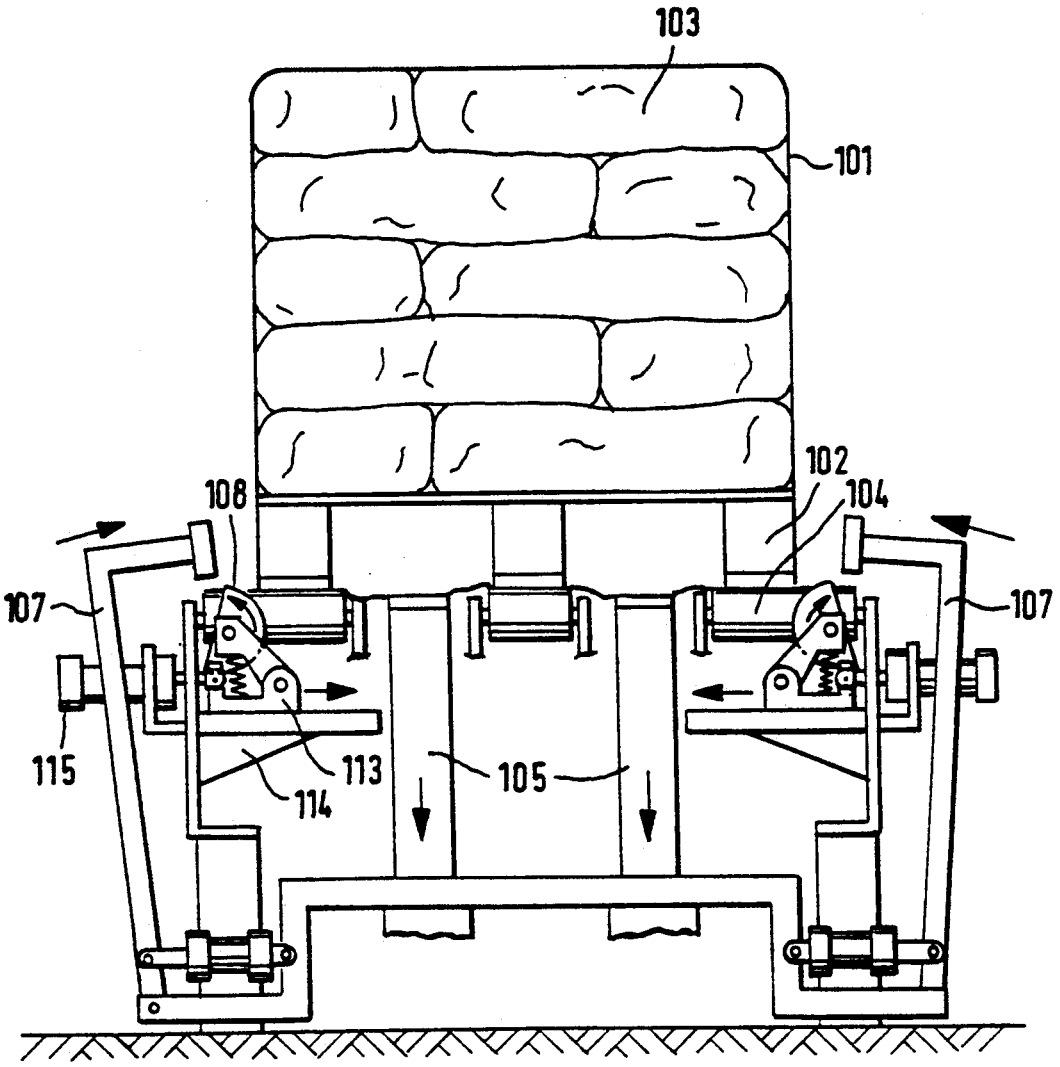
FIG. 5 is a view like FIG. 1 of another system in accordance with the invention.

(FIG. 4) to hold the edge 13 as the lifters 7 raise the package 1, 2 to stretch the bag 5 tight over it.

Sprayer nozzles 15 are provided on the lifters 7 that direct jets of an adhesive against the inside faces of the lower edges 13. In addition the sliders 9 carry rollers 16 on upper arms 17 of two arm levers 17, 18 whose lower arms 18 are connected to actuators 19 that can be pressurized to raise the rollers 16.

Figure 2:
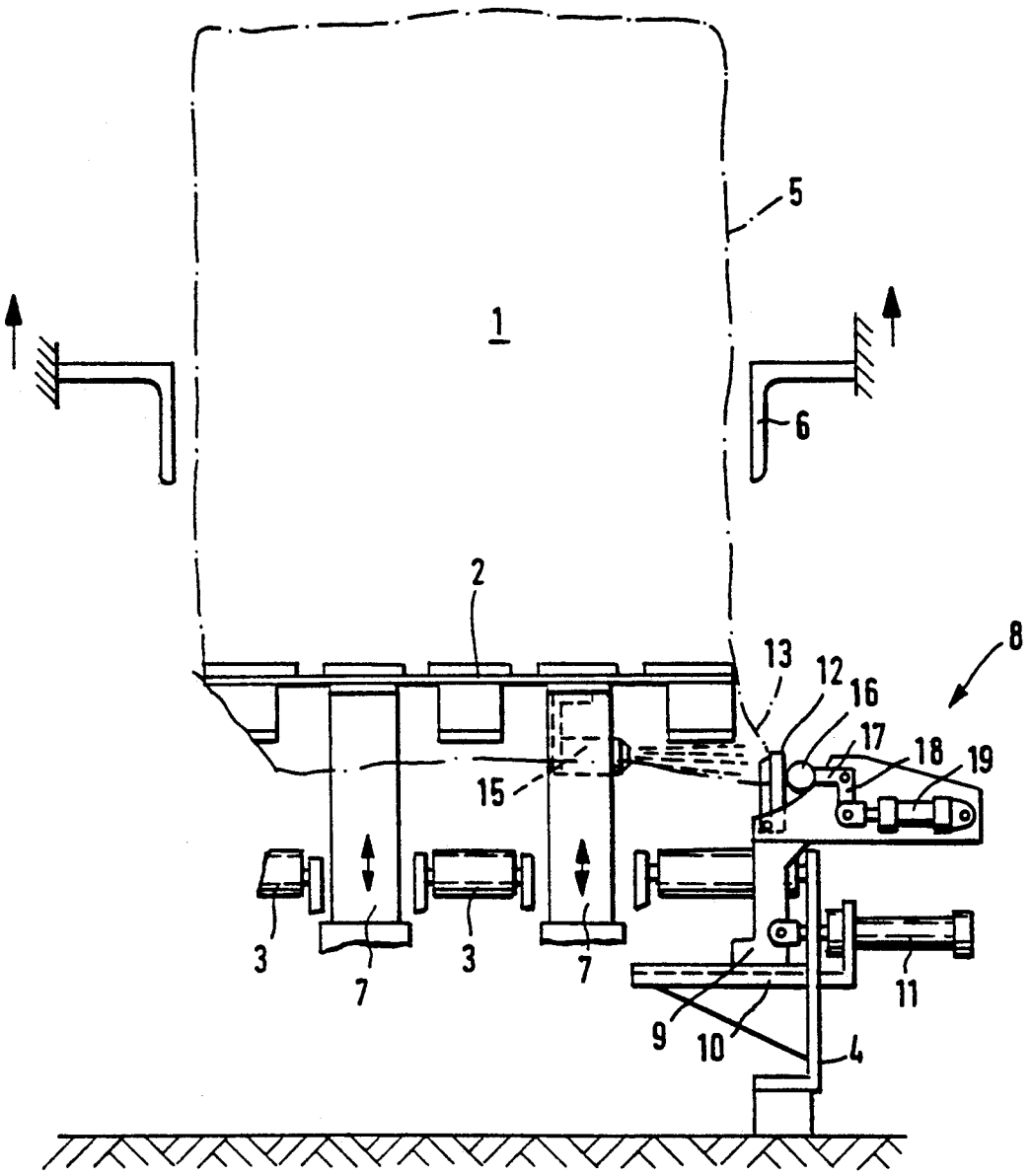

This system operates as follows:

As the bag 5 is pulled down by the holders 6 its lower edge 13 is fitted into the grippers 12 as seen in FIG. 1. Then as seen in FIG. 2 these grippers 12 are closed and the lifters 7 are raised somewhat to stretch the bag 5 tight, and the sprayers 15 are actuated to coat the inside face of the lower edge 13.

Figure 3:
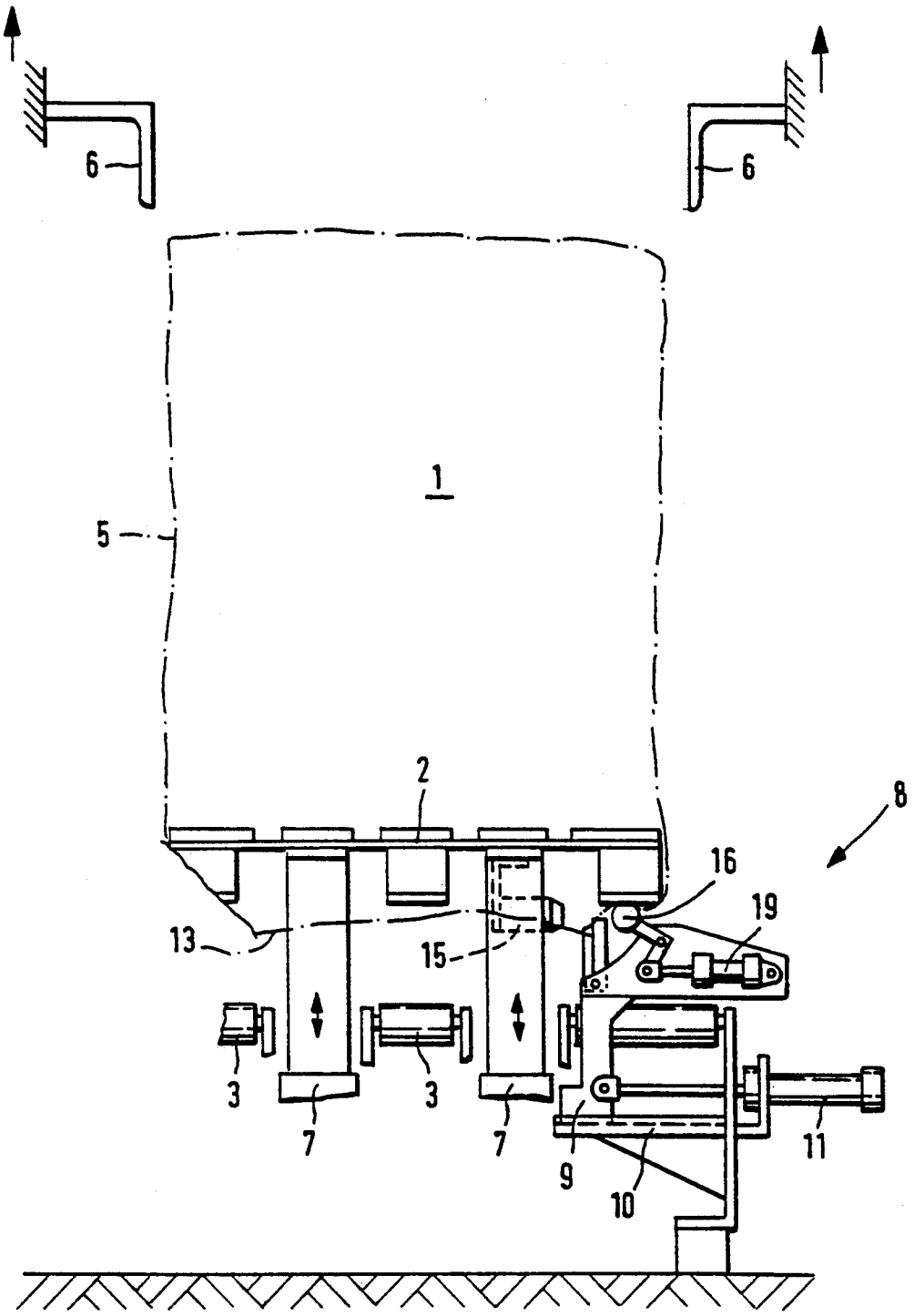

Then as seen in FIG. 3 the actuators 11 and 19 are actuated to simultaneously move in the grippers 12 with the lower edge 13 and to press the glued face of this lower edge 13 against the underside of the pallet 2. Then the grippers 12 are opened and the slides 9 retracted so that the lifters 7 can set the package 1, 5 down on the rollers 3 for transport away. This action also presses the lower edge 13 up against the pallet 2 to ensure that it sticks well.

In FIGS. 5 through 8 a stack 103 of articles on a pallet 102 is normally moved longitudinally and horizontally on rollers of a transport conveyor 104. A bag or hood 101 is engaged by four unillustrated holders and is pulled down over the stack until a lower edge 106 of the bag 101 hangs below the stack 103 at or below the pallet 102. Clamps 107 can push the lower bag edge 106 against the side of the pallet 102.

Figure 6:
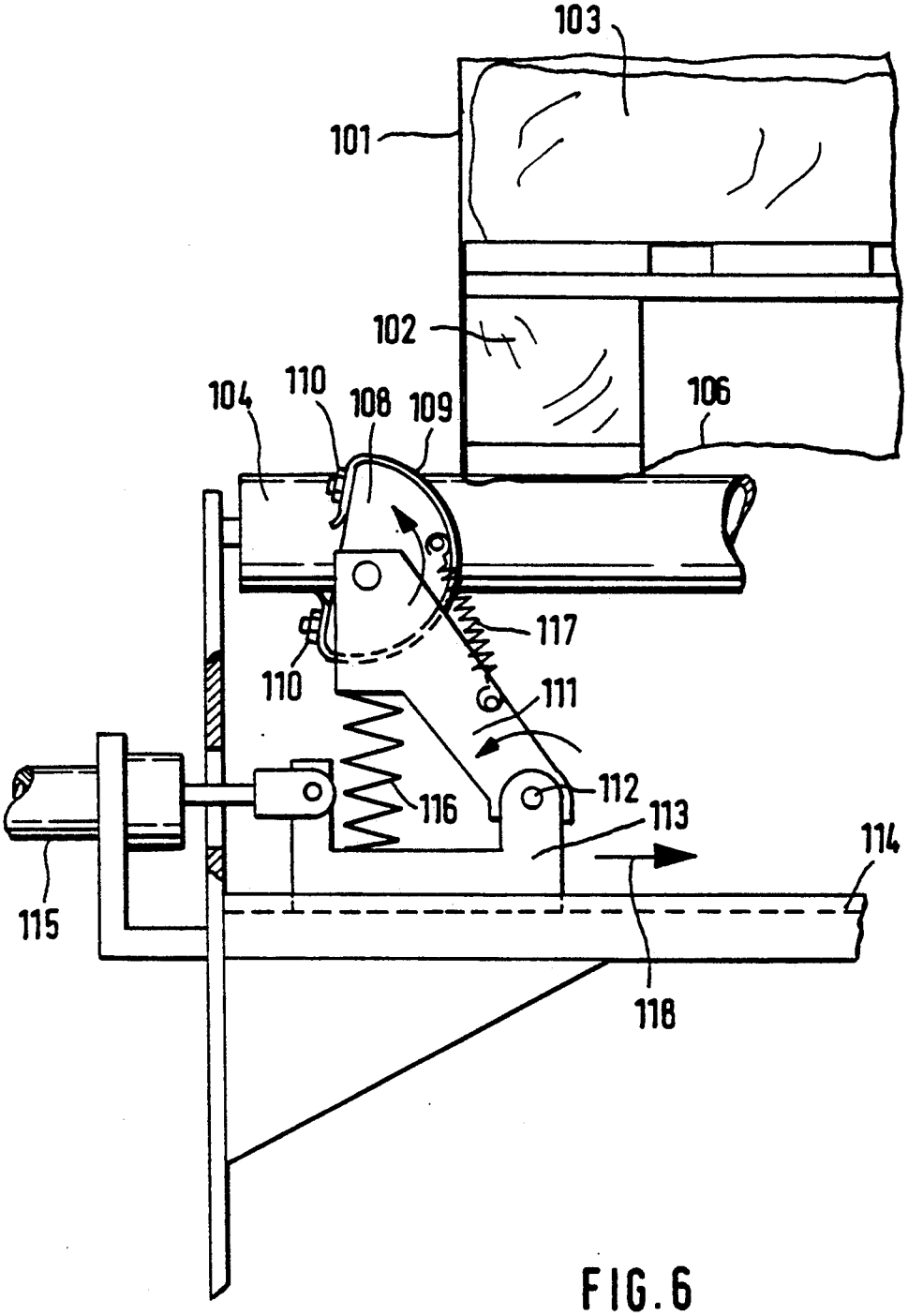
FIG. 6 is a large-scale view of a detail of FIG. 5.
Figure 7:
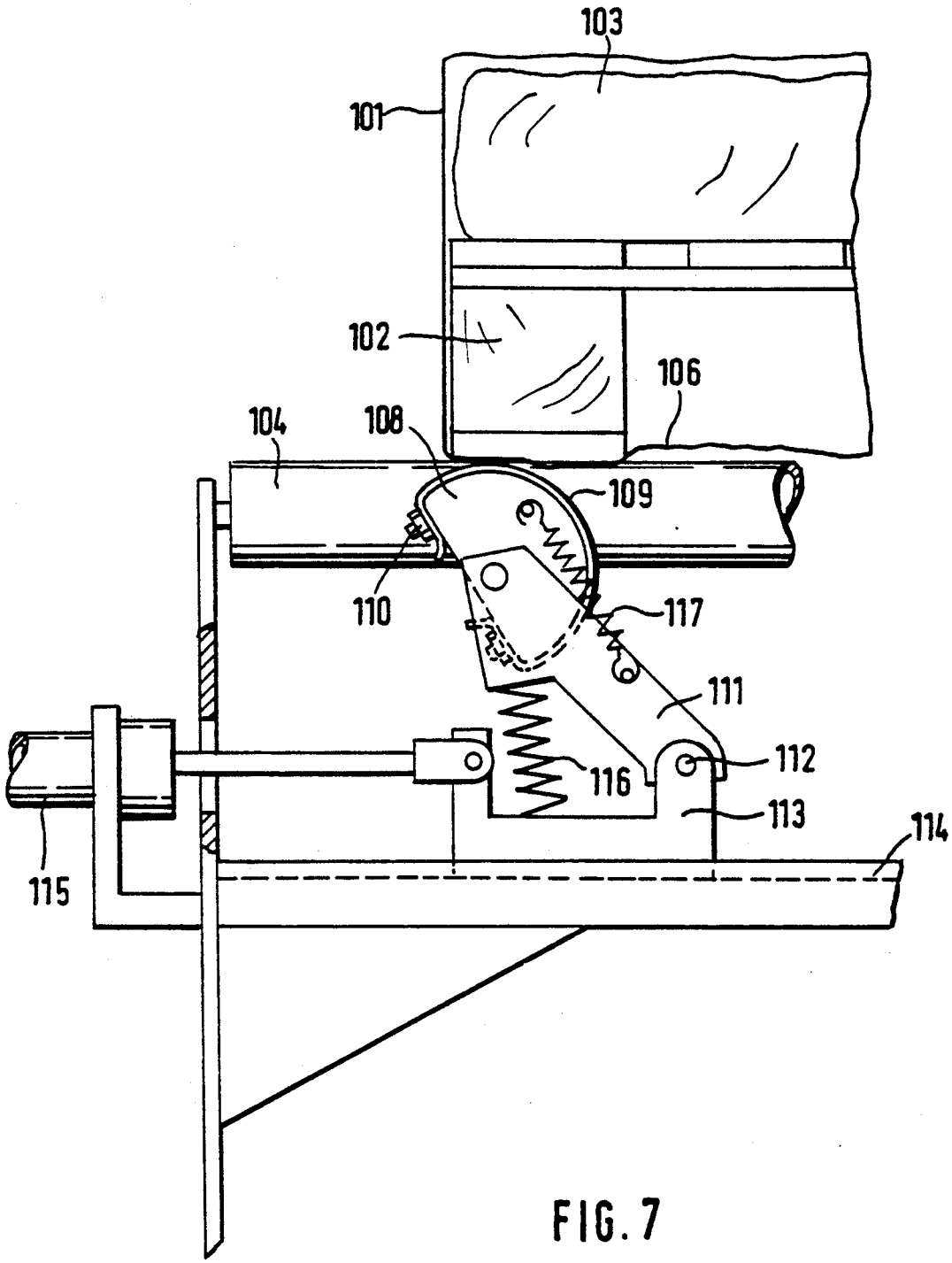
FIG. 7 is a view like FIG. 6 but showing the apparatus in a different position.

As best seen in FIGS. 6 and 7 the lower edge 106 of the bag is heat-sealed against the bottom of the pallet 102 once the package 102, 103 is raised by the lifter 105 by means of semicircular rockers 108 provided on their edges with heatable strips 109 having contacts 110 by which they are connected to a source of electricity to raise their temperature above the softening point of the resin of the bag 101. These rockers 108 are pivoted on arms 111 in turn pivoted at 112 on slides 113 movable in guides 114 by respective actuators 115. Relatively stiff springs 116 urge the arms 111 upward while relatively weak springs 117 bias the rockers 108 rotationally so that they project upward past the plane of the lower surface of the pallet 102.

Figure 8:
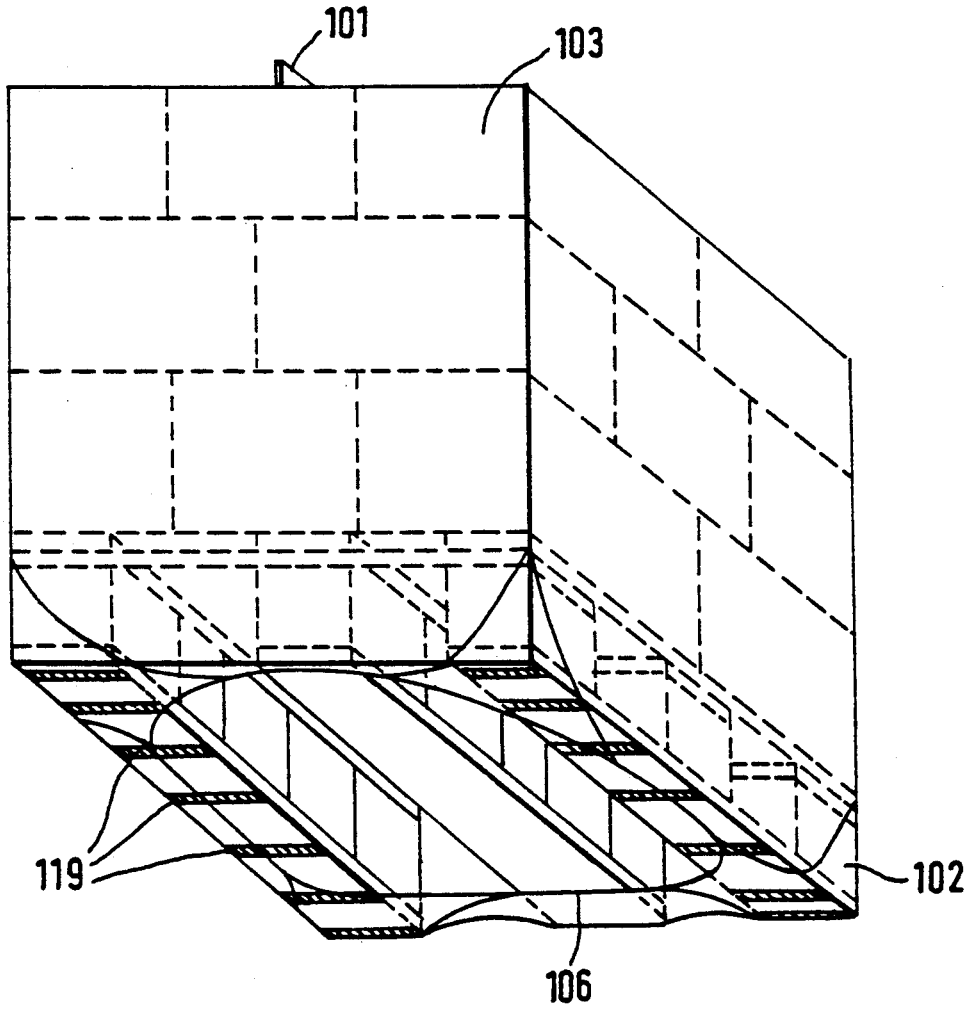
FIG. 8 is a perspective view illustrating a finished package made according to the invention.

Once the bag 101 is fitted down over the package 102, 103 as described above with reference to FIGS. 1 and 2, the actuators 115 are extended to push the slides 113 under the package 102, 103. This causes the hot strips 109 to engage the depending edge 106 and to push it up against the bottom of the pallet 102. As this happens the rockers 108 roll from the lower edge of the side and then onto the bottom pallet surface with their springs 117 extending and the arms 111 are pressed down somewhat against the springs 116 as can be seen by a comparison of FIGS. 6 and 7. The result is as shown in FIG. 8 that the edge 106 is welded at 119 to the bottom of the pallet 102.

I claim:

1. An apparatus for wrapping a package of goods having a lower surface, the apparatus comprising:

means for fitting a bag over and pulling it down over the package until a lower edge of the bag hangs past the package;

means including grippers for grabbing the hanging lower edge and pulling the grabbed lower edge down to stretch the bag snugly over the package;

means for pressing the grabbed lower edge against the lower package surface while maintaining the bag stretched over the package;

means for heating the lower edge including a plurality of heated rockers engageable with the lower edge and therethrough with the lower package surface; and means for pressing the rockers against the lower package surface and rocking them thereon for welding the lower edge to the lower package surface while maintaining the bag stretched over the package.

2. The apparatus defined in claim 1 wherein the means for pressing the rockers includes at least one spring.

3. The apparatus defined in claim 2 wherein the means for pressing the rockers includes for each rocker a slide displaceable horizontally under the package, and a lever pivoted on the slide and pivotally supporting the respective rocker, the respective spring being engaged between the rocker and the respective slide.

4. The apparatus defined in claim 3 wherein each rocker is provided with at least one electrically heatable strip.

5. The apparatus defined in claim 3 wherein each rocker is provided with a spring engaged between itself and the respective lever and urging the respective rocker into a position projecting up above a plane of the lower surface of the package.

6. The apparatus defined in claim 3, further comprising transport means including conveyor rollers for transporting the package through a station provided with the rockers, the rockers being between the rollers when pressed against the lower package surface.

7. The apparatus defined in claim 3 wherein the rockers are engageable with sides of the package.

8. The package-wrapping apparatus defined in claim 1 wherein the lower edge is grabbed at least two opposite locations and is there pulled, pressed, and attached.

9. The package-wrapping apparatus defined in claim 1 including package lifting means, wherein the grabbed lower edge is pulled down by gripping the grabbed lower edge and lifting the package with said package lifting means.

10. The package-wrapping apparatus defined in claim 1 including gluing means, wherein the lower package edge is attached by gluing it to the lower package surface.

11. The apparatus defined in claim 1 wherein the grippers are provided opposite each other on opposite sides of the package.

* * * * *